US005749538A

United States Patent [19]

Brown et al.

[11] Patent Number: 5,749,538

[45] Date of Patent: May 12, 1998

[54] GRAVITY-OPERATED DISPENSING APPARATUS

[75] Inventors: John Hiram Brown, Marietta, Ga.; Kenneth Harry LaCount, Pulaski, Wis.; Terry Lyle Petty, Roswell, Ga.

[73] Assignee: Kimberly-Clark Corp., Neenah, Wis.

[21] Appl. No.: 510,210

[22] Filed: Aug. 2, 1995

[51] Int. Cl.[6] ..... B65H 9/10

[52] U.S. Cl. ..... 242/559.2; 242/560; 242/597.3

[58] Field of Search ..... 242/559.1, 559.2, 242/559.3, 594.5, 597, 597.3, 560

[56] References Cited

U.S. PATENT DOCUMENTS

| | | | |
|---|---|---|---|
| 1,851,722 | 3/1932 | Moore | 242/597.3 X |
| 3,038,677 | 6/1962 | Schermerhorn . | |
| 3,294,329 | 12/1966 | Tucker et al. . | |
| 3,381,909 | 5/1968 | Tucker et al. . | |
| 3,484,052 | 12/1969 | Clarke | 242/597.3 X |
| 3,552,669 | 1/1971 | Earnest . | |
| 4,108,513 | 8/1978 | Lander . | |
| 4,422,584 | 12/1983 | Dashnier et al. . | |
| 4,557,426 | 12/1985 | Siciliano . | |
| 4,595,153 | 6/1986 | Goetz | 242/597.3 X |
| 5,310,129 | 5/1994 | Whittington et al. . | |
| 5,636,812 | 6/1997 | Conner et al. | 242/559.2 |

FOREIGN PATENT DOCUMENTS

| | | | |
|---|---|---|---|
| 2537865 | 6/1984 | France . | |
| 8 602 194 | 3/1988 | Netherlands | 242/559.2 |
| 2 245 882 | 1/1992 | United Kingdom | 242/559.2 |

*Primary Examiner*—Daniel P. Stodola
*Assistant Examiner*—William A. Rivera
*Attorney, Agent, or Firm*—K. V. Sidor

[57] ABSTRACT

A gravity-operated apparatus for sequentially dispensing sheet material from rolls of sheet material. The apparatus includes a housing having an opening; a rotatable turret; arms extending perpendicularly from the rotatable turret, each arm being offset and extending a sufficient distance to provide clearance for a roll of sheet material; a cantilevered spindle extending from a distal portion of each arm so that each spindle is positioned generally parallel to the rotating turret and is adapted to receive a roll of sheet material; means on each spindle to secure the roll of sheet material on the spindle; and a limit gate. Each cantilevered spindle extends from a distal portion of each arm so that the weight of a full roll of sheet material on the spindle urges the turret to rotate placing a full roll of sheet material at a dispensing position. The limit gate is positioned to impede rotation of the turret when the limit gate encounters a spindle containing a roll of sheet material that is less than substantially depleted.

20 Claims, 7 Drawing Sheets

GRAVITY-OPERATED DISPENSING APPARATUS

FIELD OF THE INVENTION

The present invention relates to an apparatus for sequentially dispensing sheet material from rolls of sheet material.

BACKGROUND

It is desirable to dispense rolls of sheet material such as, for example, rolls of bathroom tissue, in a sequential manner. Dispensers that store and sequentially dispense rolls of sheet material can be used to insure that a reserve roll or rolls is available when the dispensing roll is depleted. Occasionally, this can be extremely important in situations such as, for example, public and institutional washroom facilities.

Dispensers that store and sequentially dispense rolls of sheet material have another advantage in that they do not need to be reloaded each time the dispensing roll is depleted. In the past, dispensers have been designed to contain one or more reserve rolls of material that can be used when the roll at the dispensing position is depleted. In some cases, these designs require mechanical adjustment of the dispenser by a user to gain access to a reserve roll or to have a reserve roll sequentially placed in a dispensing position. Such contact between a user and a dispenser can be undesirable, especially in settings such as public rest rooms.

Dispensers have been developed with features that automatically advance a reserve roll into a dispensing position. Generally speaking, automatic dispensers tend to be complex, expensive and have the potential to jam. Some automatic dispensers use complex position locking mechanisms and/or springs, gears or the like. Such complicated features tend to be expensive, unreliable, and have the potential to jam. Other automatic dispensers require special cores or collapsing cores for proper operation. Such requirements may add expense and complexity to the dispenser.

Accordingly, there is a need for a simple, inexpensive apparatus for sequentially dispensing sheet material from rolls of sheet material. There is also a need for a simple, gravity-operated apparatus for sequentially dispensing sheet material from rolls of sheet material. A need also exists for a simple, gravity-operated apparatus for sequentially dispensing sheet material from rolls of sheet material without the requirement of special cores or collapsing cores.

SUMMARY OF THE INVENTION

The problems described above are addressed by a gravity-operated apparatus for sequentially dispensing sheet material from rolls of sheet material. The apparatus includes a housing having an opening; a rotatable turret; arms extending perpendicularly from the rotatable turret, each arm being offset and extending a sufficient distance to provide clearance for a roll of sheet material; a cantilevered spindle extending from a distal portion of each arm so that each spindle is positioned generally parallel to the rotating turret and is adapted to receive a roll of sheet material; retaining means on each spindle to secure the roll of sheet material on the spindle; and a limit gate. Each cantilevered spindle extends from a distal portion of each arm so that the weight of a full roll of sheet material on the spindle (at any position other than a dispensing position) urges the turret to rotate placing a full roll of sheet material at a dispensing position. The limit gate is positioned to impede rotation of the turret when the limit gate encounters a spindle containing a roll of sheet material that is less than substantially depleted.

In an aspect of the present invention, the rotatable turret may be a circular disc. In another aspect of the invention, the rotatable turret may composed of struts extending radially outward from and joined at a central point.

The rotatable turret may include a first cantilevered spindle extending from a distal portion of a first arm and a second cantilevered spindle extending from a distal portion of a second arm. According to the invention, these spindles extending from the first arm and the second arm are offset so that the spindles extend beyond the central portion of the turret to create an unbalanced condition when rolls of sheet material are loaded on the spindles.

According to the invention, the sheet material may be a fibrous cellulosic material. Desirably, the sheet material is paper. More desirably, the sheet material is paper tissue. The sheet material may be wound into a coreless roll. Desirably, the sheet material is wound on a core to form a roll.

According to the invention, the turret may be attached to the housing. The housing may be composed of a front wall, a top wall, and side walls. The housing may include a pivoting cover.

The limit gate may be a limit roller or a limit pin. In some embodiments of the present invention, the limit gate may be adjustable. The limit gate may be affixed to the housing.

Generally speaking, the retaining means on each spindle to secure the roll of sheet material on the spindle may be a catch, latch, stop, cinch, friction fitting, or the like. Desirably, the retaining means on each spindle to secure the roll on the spindle may be a friction fitting which holds a roll of sheet material in place by a snug fit with the core of the roll. The retaining means may also be compressible, movable or otherwise repositionable to permit loading of a roll of sheet material onto the spindle and removal of a core from the spindle.

The present invention also contemplates a method of sequentially dispensing sheet material from rolls of sheet material.

The method includes the step of loading a first roll of sheet material onto a first cantilevered spindle that extends from a distal portion of a first arm and a second roll of sheet material onto a second cantilevered spindle that extends from a distal portion of a second arm, each cantilevered spindle extending from a distal portion of each arm and each arm extending from a rotatable turret so that the weight of a full roll of sheet material on the spindle (at any position other than a dispensing position) urges the turret to rotate so that a full roll of sheet material is held at a dispensing position.

That is, an unbalanced condition is created by the weight of a full roll of sheet material at any position other than a dispensing position such that the turret is urged to rotate under the influence of gravity so that a full roll of sheet material is held at a dispensing position.

Rotation of the turret and the full rolls installed on the spindles affixed to the turret is impeded when the first full roll reaches a limit gate at the dispensing position.

The first roll is substantially depleted by unwinding sheet material from the roll.

Once the first roll becomes substantially depleted, rotation of the turret and the remaining full roll of sheet material (i.e., the second roll) resumes under the influence of gravity until the remaining full roll (i.e., the second roll) reaches the limit gate at the dispensing position.

DETAILED DESCRIPTION

Figure 1:
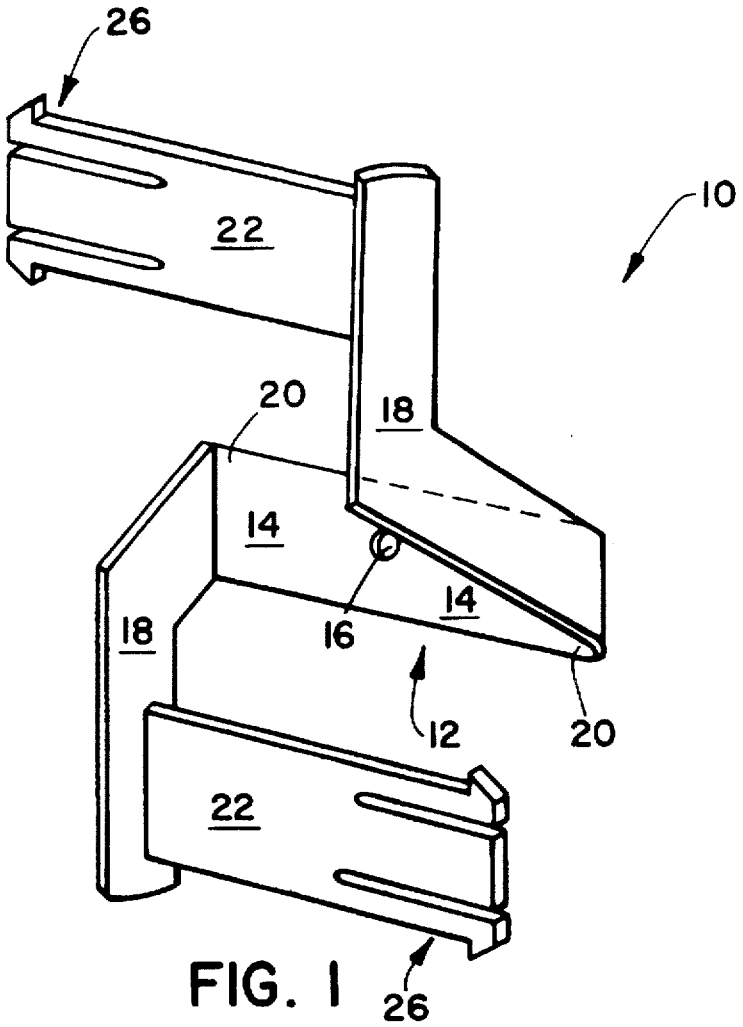
FIG. 1 is an illustration of an exemplary turret portion of an exemplary gravity-operated apparatus for sequentially dispensing sheet material from rolls of sheet material.

Referring now to the drawings and in particular FIG. 1, there is shown at 10 a portion of a gravity-operated apparatus for sequentially dispensing sheet material from rolls of sheet material. The apparatus includes a turret 12 that includes two struts 14 extending radially outward from and joined at a central point or axis 16. The turret 12 is pivotable or rotatable about the axis.

Arms 18 extend generally perpendicularly from the struts 14. Desirably, the arms 18 are cantilevered arms that extend from the ends or from distal portions 20 of the struts in a generally perpendicular manner and with sufficient distance to provide clearance for a full roll of sheet material. The term "cantilevered" as it relates to the arms 18 is used to describe the configuration in which the arms are joined or united to the turret (i.e., the struts 14) at their base. The term "distal" as it relates to the struts 14 is used to described locations that are far from the central point or axis 16 of the turret 12 (i.e., at the portion of the strut 14 farthest from the axis 16).

Cantilevered spindles 22 extend generally perpendicularly from the arms 18 at the distal portions 24 of the arms. That is, the spindles 22 extend from the arms 18 so that they are generally parallel to the rotating turret (i.e., the struts 14). The term "cantilevered" as it relates to the spindles 22 is used to describe the configuration in which the spindles 22 are joined or united to the arms 18 at their base. The term "distal" as it relates to the arms 18 is used to described locations that are farthest from the common point between each arm 18 and the turret 12 (i.e., the portion of the arm farthest from the point where the arm 18 begins to extend from the strut 14).

Generally speaking, each spindle 22 and arm 18 combination extends from a distal portion 20 of the turret 12 so the weight of a full roll of sheet material on the spindle urges the turret to rotate placing a full roll of sheet material at a dispensing position.

Figure 2A:
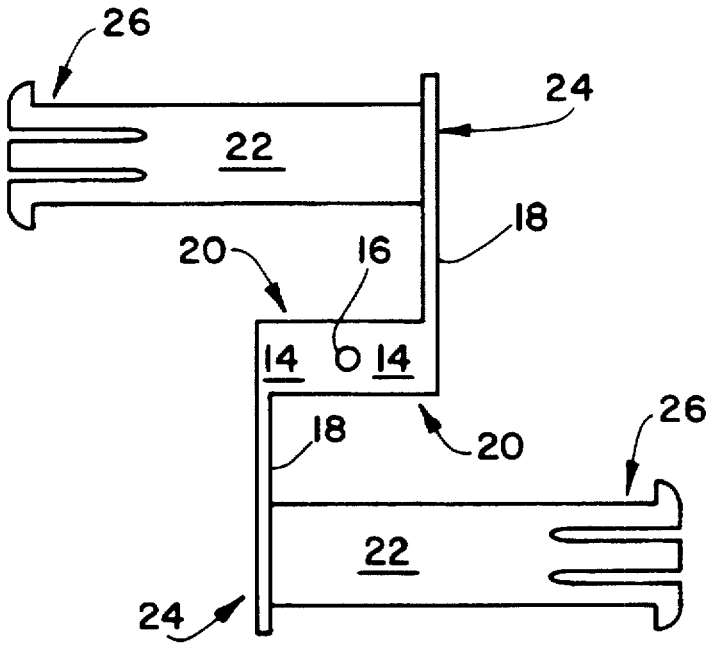
FIG. 2A is an illustration of an exemplary turret portion of an exemplary dispensing apparatus.

FIG. 2A of the drawings is a front view of a turret illustrating an exemplary offset (i.e., difference in length between the turret and the spindles) which may be used to create an unbalanced condition that urges the turret to rotate as desired when full rolls of material are loaded on the spindles. There is shown a turret that includes two struts 14 extending from a central axis 16. Arms 18 extend generally perpendicularly from the distal portions 20 of the struts and cantilevered spindles 22 extends from the distal portions 24 of the arms 18. As can be seen, the spindles 22 extend beyond the struts 14. When full rolls of sheet material are loaded on the spindles, the relatively short dimensions of the struts 14 extending from the central axis 16 are unable to balance the weight of the full rolls of sheet material on the relatively long spindles 22. The unbalanced condition created by the offset of the centers of gravity of the spindles and rolls when they are aligned horizontally urges the turret to rotate. It is contemplated that one can use any offset between the between the centers of gravity of horizontally aligned spindles when full rolls of sheet material are loaded on the spindles which creates an unbalanced condition sufficient to urge the turret to rotate and force the lower roll against the limit gate. That is, the offset between the centers of gravity when the rolls and spindles are aligned perpendicular to the direction of gravity should be sufficient to create an unbalanced condition that urges the turret to rotate and force the lower roll of sheet material against the limit gate.

It should be noted that the struts, arms and spindles in FIGS. 1 and 2A, are generally configured to have a "Z" pattern. When loaded with full rolls of material, the turret will rotate in the counter-clockwise direction.

If desired, a latch or ratchet may be positioned to prevent clockwise rotation but otherwise allow counter-clockwise rotation. That is, when a spindle (and its associated arm and strut) is about to enter the dispensing position, a latch or ratchet may be positioned so that the strut can slide just past the latch or ratchet by counter-clockwise rotation of the turret into the dispensing position, but the strut is prevented from clockwise rotation back out of the dispensing position by the latch or ratchet.

Figure 2B:
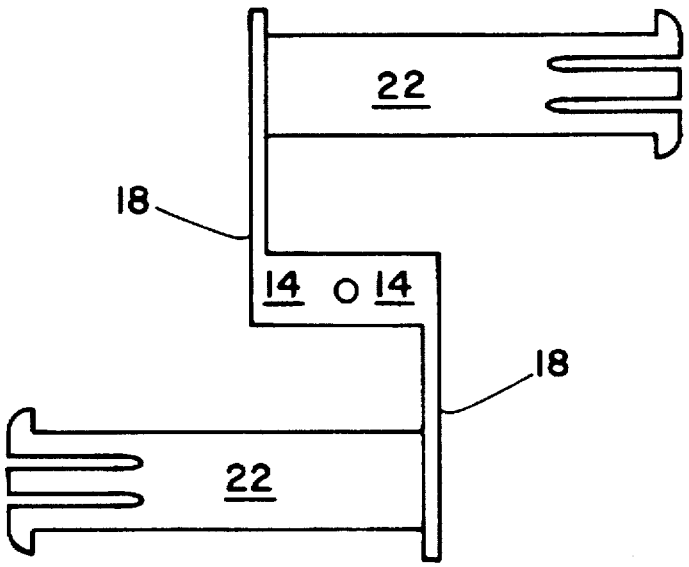
FIG. 2B is an illustration of an exemplary turret portion of an exemplary dispensing apparatus.

FIG. 2B is an illustration of an exemplary turret portion of the apparatus of the present invention. The turret illustrated in FIG. 2B is different from the one illustrated in FIGS. 1 and 2A in that the struts 14, arms 18 and spindles 22 are generally configured to have an "S" pattern (i.e., a mirror image of the "Z" pattern). When loaded with full rolls of material, the turret will also rotate in the counter-clockwise direction.

Of course, it should be understood that the apparatus of the present invention may easily be configured so the turret rotates in the clockwise direction for proper operation.

Referring again to FIG. 1, the spindles 22 may be mounted or attached to the arms 18 which, in turn, may be mounted or attached to the struts 14. Alternatively, the turret 12 composed of spindles 22, arms 18 and struts 14 may be formed or cast as one piece. In yet another configuration, the turret may be composed of struts and arms formed or cast as one piece and the spindles may be mounted or attached to the arms. In still another configuration, the spindles and arms may be formed or cast as one piece and may be mounted or attached to turret.

Figure 1A:
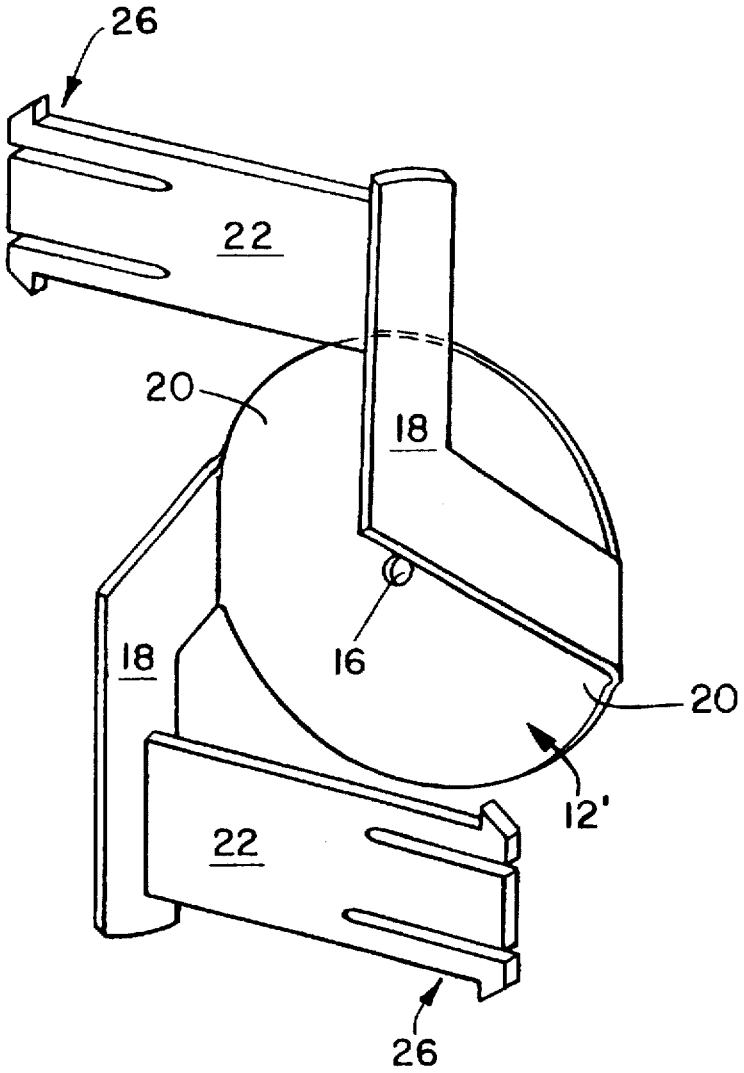
FIG. 1A is an illustration similar to FIG. 1 of an alternative exemplary turret portion.

It should be understood that other turret configurations are contemplated. For example, the turret may be a circular disc or the like having arms extending from distal portions and spindles extending from the arms. Such a disc-like turret 12' is shown in FIG. 1A. Other parts of the device in FIG. 1A are shown by the same reference numbers as in FIG. 1. The spindles and/or arms themselves may be hollow, solid, cylindrical, cross-hatched or any other configuration suitable to hold a roll of sheet material. The spindles may also be rotatable or pivotable at the point where they are connected to the arm to aid in the dispensing of the sheet material from the roll.

The retaining means 26 on each spindle to secure the roll of sheet material on the spindle 22 may be a catch, latch, stop, cinch, friction fit, or the like. In FIG. 1, the retaining means 26 are shown as a catch, latch or stop. Such retaining means may be compressible, movable or otherwise repositionable to allow loading of a full roll of sheet material and/or removal of a core after the roll has been depleted.

Figure 3:
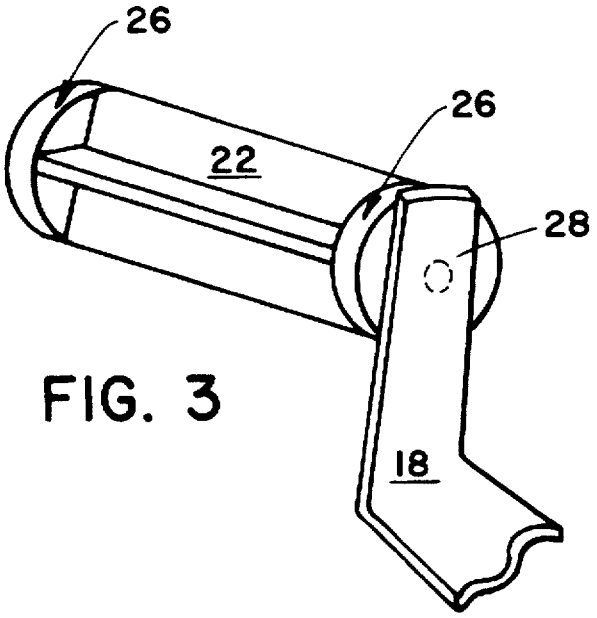
FIG. 3 is an illustration of an exemplary retaining means from a portion of an exemplary dispensing apparatus.

Referring now to FIG. 3 of the drawings, there is illustrated another example of the retaining means 26 that may be used to secure the roll of sheet material on the spindle 22. In this illustration, the retaining means provide a friction fit between the core of the roll and the spindle. As seen in FIG. 3, a first and a second retaining means may be employed at, for example, each end of the spindle. One or both of the retaining means may be rings or sleeves adapted to glide or rotate on a fixed spindle to enable rotation of a roll of sheet material with little applied force. For example, each retaining means (e.g., ring or sleeve) may be adapted to rotate or glide on the spindle (or move on bearings) thereby allowing sheet material to be unrolled from the roll of sheet material with relatively little applied force. In another embodiment, the retaining means may be fixed on the spindle 22 to provide a friction fit and the entire spindle 22 may be adapted to rotate on about an axis or center point 28. Desirably, the retaining means 26 on each spindle to secure the roll on the spindle may be compressible, movable or otherwise repositionable to permit loading of a roll of sheet material onto the spindle and removal of a core from the spindle.

Figure 4:
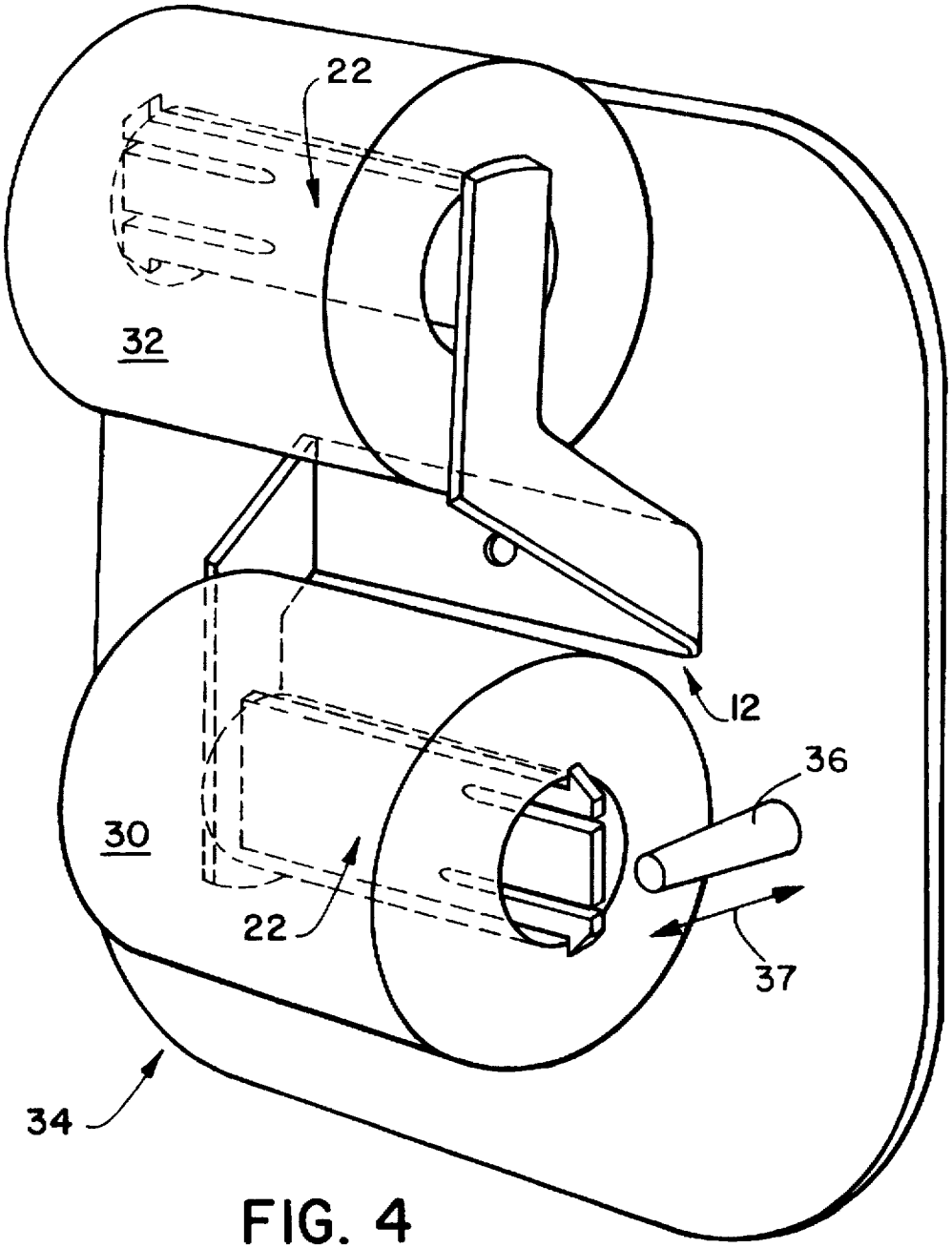
FIG. 4 is an illustration of an exemplary gravity-operated apparatus for sequentially dispensing sheet material from rolls of sheet material.

As may be seen in FIG. 4, the turret 12 is placed in an unbalanced condition by inserting two rolls of sheet material 30 and 32 on the two spindles 22 when the rolls and spindles are horizontally aligned. That is, an unbalanced condition is created by the offset of the centers of gravity of the horizontally aligned spindles and rolls. The unbalanced condition urges the turret to rotate and force the roll 30 of sheet material into the dispensing position 34 and against a limit gate 36. Generally speaking, the term "gravity-operated" refers to an apparatus that relies on gravity as manifested in the weight of a particular component to provide some action substantially free from the aid of motors, springs or like sources to generate a force. It is generally thought that the combined weight of the turret and spindles should not be so disproportionately large (i.e., much greater than the weight of a full roll (or rolls) of sheet material) as to minimize the driving force provided by the weight of roll (or rolls) on the turret to generate rotation.

Figure 5A:
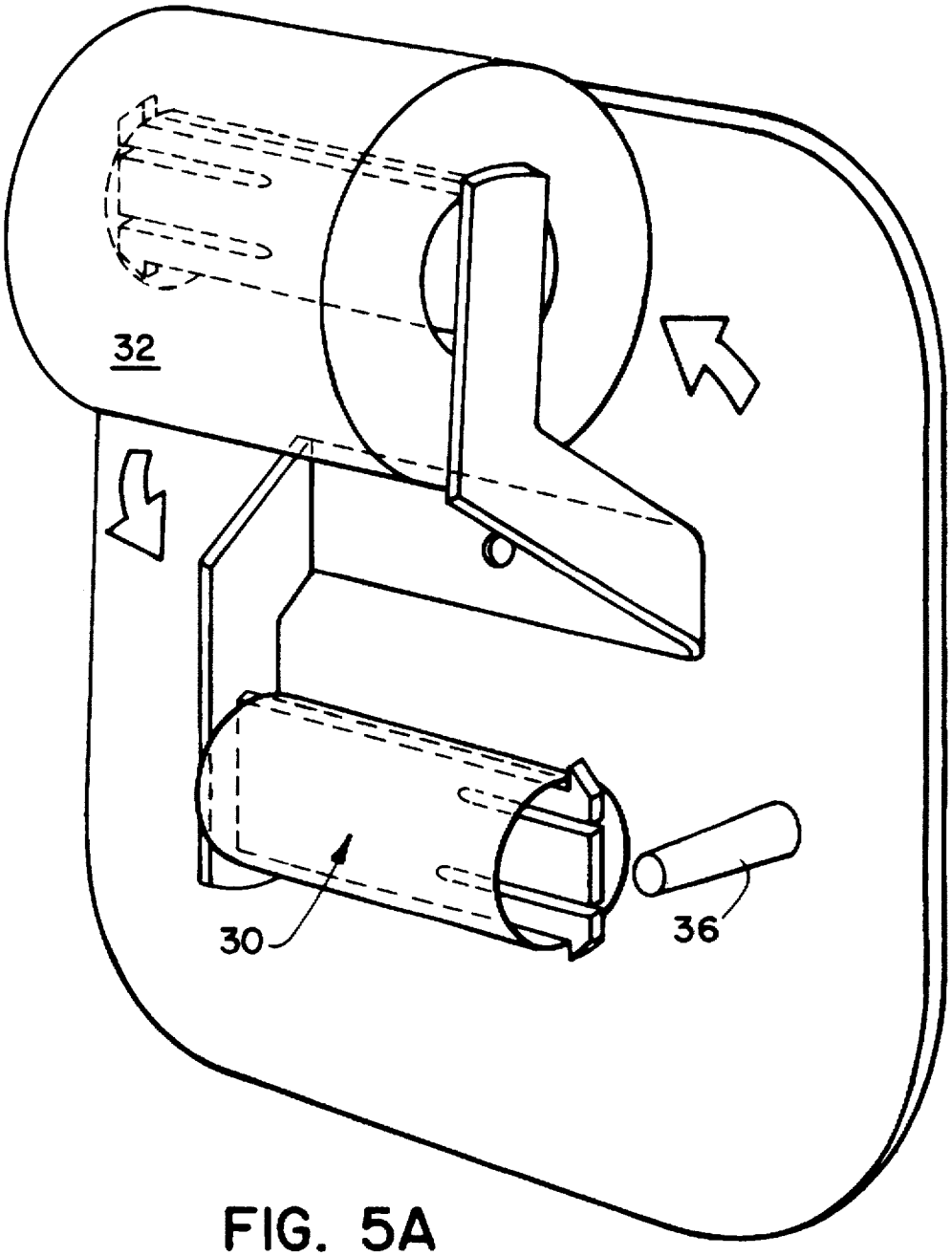
FIG. 5A is an illustration of the apparatus of FIG. 4 showing one roll of sheet material substantially depleted.
Figure 5B:
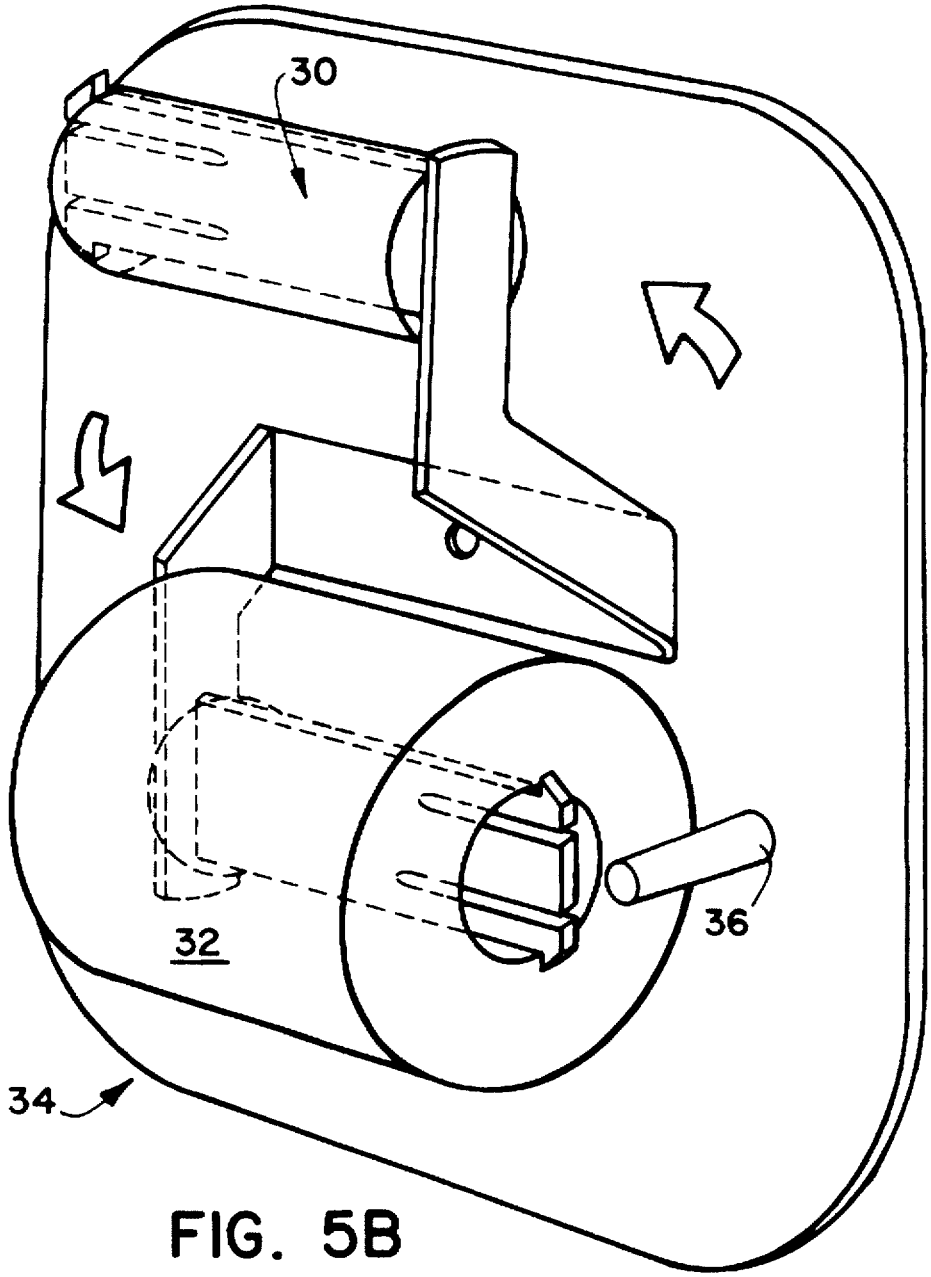
FIG. 5B is an illustration of the apparatus of FIG. 4 showing one full roll of sheet material in the dispensing position.

Referring now to FIG. 5A, the first roll 30 becomes substantially depleted by unwinding sheet material from the roll. In its depleted state, the first roll 30 is able to pass the limit gate 36. Once the first roll 30 is substantially depleted and able to pass the limit gate 36, rotation of the turret 12 with the remaining full roll of sheet material 32 resumes under the influence of gravity (and along the direction of the arrows shown therewith). Rotation is generated by the differences in weight between the substantially depleted first roll 30 and the remaining full roll 32 in the reserve position. The turret rotates until the remaining full roll 32 reaches the limit gate 36 at the dispensing position 34 as shown in FIG. 5B and the substantially depleted first roll 30 (being much lighter) reaches a reserve position directly above the dispensing position 34.

Referring back to FIG. 4, the limit gate 36 is positioned to impede rotation of the turret 12 when the limit gate 36 encounters a spindle 22 containing a roll of sheet material that is less than substantially depleted. The limit gate 36 may be a limit roller, limit pin, limit post or the like. The limit gate 36 may be adjustable in a manner such as, for example, indicated by arrow 37.

Figure 6:
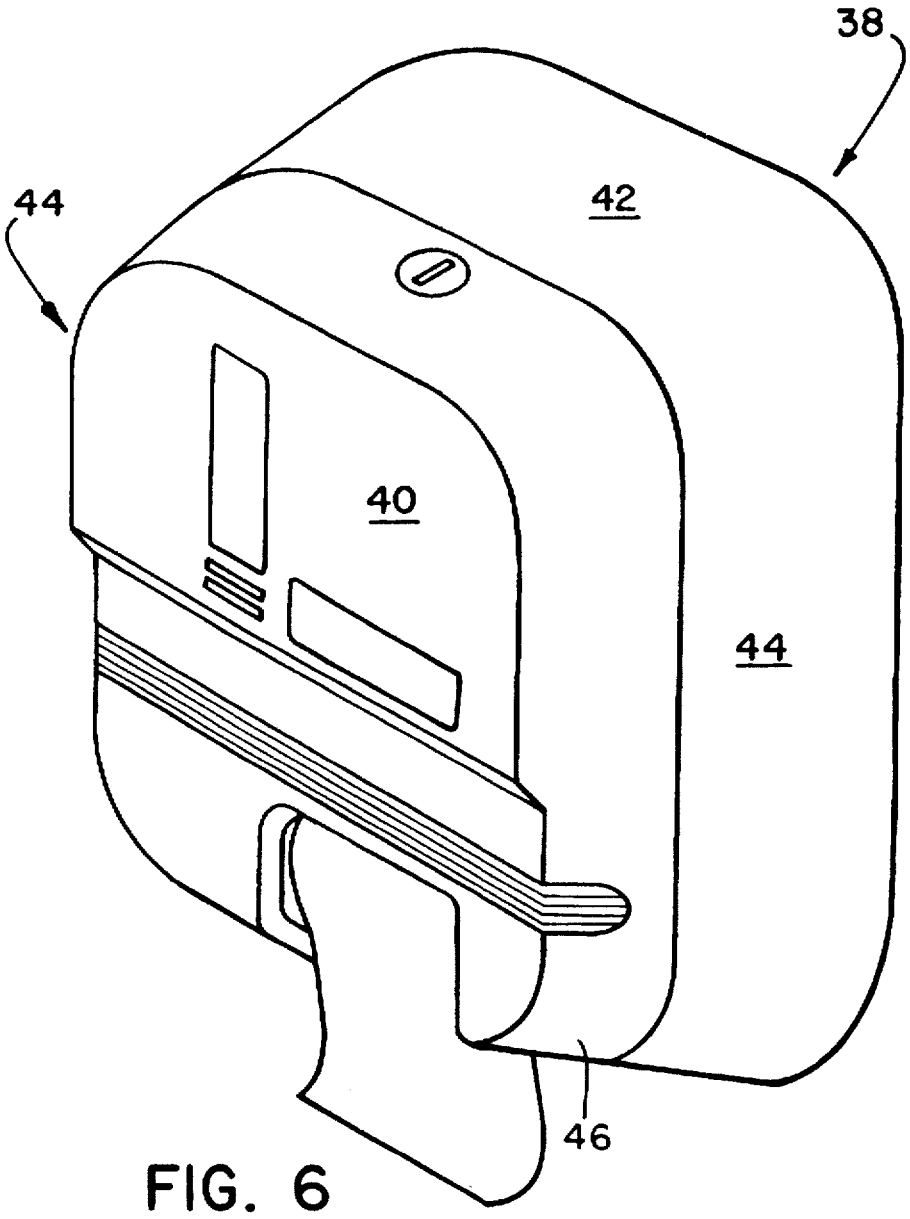
FIG. 6 is an illustration of an exemplary housing for an exemplary gravity-operated apparatus for sequentially dispensing sheet material from rolls of sheet material.

According to the invention, the apparatus for dispensing sheet material from rolls may include a housing. FIG. 6 depicts an exemplary housing at 38. The housing may be composed of a front wall 40, a top wall 42, and side walls 44. The housing may contain or include a pivoting cover 46 as well as latches, hinges, locks, brackets or the like that may be found in conventional dispenser designs. In one aspect of the invention, the turret may be attached to the housing. Alternatively and/or additionally, the limit gate may be attached to the housing. It is also contemplated that the turret and/or the limit gate may be attached to a support base that is connected to a housing.

In an embodiment of the invention, the housing may be configured so that the turret containing full rolls of sheet material is able to rotate in only one direction (e.g., only in the counter-clockwise direction). This may be accomplished independently of any latch or ratchet mechanism to control rotation and can be achieved by configuring the housing so the clearance between a spindle and the wall of the housing just above the limit gate is just enough to let only a substantially depleted roll pass as the reserve roll rotates into the dispensing position 34 and the empty spindle rotates beyond the limit gate 36 to the reserve position.

Generally speaking, the dispensing apparatus may be used to sequentially dispense any flexible sheet material that can be wound on a roll and dispensed in individual portions. In many cases, the sheet material may be a fibrous cellulosic material such as, for example a nonwoven web of cellulosic fibers that has a structure of individual fibers which are interlaid, but not in an identifiable repeating manner. Such webs have been, in the past, formed by a variety of nonwoven manufacturing processes known to those skilled in the art such as, for example, air-forming, wet-forming and/or papermaking processes. Exemplary fibrous cellulosic materials include papers, paper tissues and the like. Such materials can be treated to impart desired properties utilizing processes such as, for example, calendering, creping, hydraulic needling, hydraulic entangling and the like. Generally speaking, the cellulosic fibrous material may be prepared from cellulose fibers from natural sources such as woody and non-woody plants. The cellulose fibers may be modified by various treatments such as, for example, thermal, chemical and/or mechanical treatments. It is contemplated that reconstituted and/or synthetic cellulose fibers may be used and/or blended with other cellulose fibers of the fibrous cellulosic material.

Desirably, the sheet material is paper. More desirably, the sheet material is paper tissue. The sheet material may be wound into a coreless roll. However, the use of a coreless roll in not required for successful operation of the present invention. In fact, in an aspect of the invention, it is desirable for the sheet material to be wound on a hollow core to form a roll.

In an embodiment of the invention, the dispenser may be configured to sequentially dispense bathroom tissue from individual rolls wound about a core. Generally speaking, the standard dimensions of such individual rolls of bathroom tissue may be about 3 to about 5 inches in width and from about 3 to about 5 inches in diameter. Accordingly, embodiments of the dispensing apparatus may have dimensions suited to hold and store standard sized rolls of bathroom tissue.

The dispensing apparatus may be manufactured from any suitable material. The entire apparatus may be made from one material or combinations of materials may be used. Exemplary materials include plastics and metals.

The method of the present invention relates to the sequential dispensing of sheet material from rolls of sheet material. The rolls may have cores or may be coreless.

Generally speaking, the method includes the step of loading a first roll of sheet material onto a first cantilevered spindle that extends from a distal portion of a first arm and a second roll of sheet material onto a second cantilevered spindle that extends from a distal portion of a second arm, each cantilevered spindle extending from a distal portion of each arm and each arm extending from a rotatable turret so that the weight of a full roll of sheet material on the spindle (at any position other than a dispensing position) urges the turret to rotate so that a full roll of sheet material is held at a dispensing position.

That is, an unbalanced condition is created by the weight of full rolls of sheet material at any position other than a dispensing position so that the turret will rotate under the influence of gravity to place a full roll of sheet material at a dispensing position. It is contemplated that spindles and/or arms may be offset or otherwise configured to enhance the unbalanced condition created by the weight of full rolls of sheet material at any position other than the dispensing position. For example, one of the arms could be positioned on the strut closer to the pivot or center point than the other arm.

It is contemplated that the rotatable turret could have more than two sets of arms and spindles (e.g., three or more spindles) as long as the arms and spindles were positioned such that loading full rolls of sheet material on at least one spindle other than at the dispensing position produced an unbalanced condition that urges the turret to rotate.

Rotation of the turret and the full rolls installed on the spindles affixed to the turret is impeded when the first full roll reaches a limit gate at the dispensing position.

The first roll is depleted by unwinding sheet material from the roll. As the first roll is becomes substantially depleted, it is finally able to slip past the limit gate and rotation of the turret and the remaining full roll of sheet material resumes under the influence of gravity until the remaining full roll reaches the limit gate at the dispensing position. The substantially depleted roll, being much lighter, is rotated upward and out of the way.

Reloading of the dispensing apparatus is accomplished by opening the housing or cover, disposing of the depleted core, if any, and loading a new reserve roll on the spindle at the reserve position. If the dispenser has more than two sets of arms and spindles (i.e., is capable of holding more than two full rolls of sheet material), it is desirable that the housing or cover be configured so that full rolls of sheet material can be loaded onto a spindle (or spindles) at the reserve position (or reserve positions). This may be accomplished by placing baffles or a blocking device at the non-reserve position (or positions) and/or configuring the housing so there is insufficient clearance around a spindle at the non-reserve position (or positions) to hold a full roll.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A gravity-operated apparatus for sequentially dispensing sheet material from rolls of sheet material, the apparatus comprising:

a housing having an opening;

a turret rotatable about a central point said turret being located on a vertical wall of the housing and rotatable in a plane generally parallel to the plane of the vertical wall;

arms extending perpendicularly from the turret at respective locations radially outward from said central point a sufficient distance to provide clearance for a roll of sheet material;

a cantilevered spindle extending perpendicularly from a portion of each arm in the general direction of the central point so that each spindle is positioned generally parallel to the plane of rotation of the turret and is adapted to receive a roll of sheet material, each spindle having a length that is greater than the longest distance between the points where the arms extend from the turret, whereby the difference between the length of each spindle and the longest distance between the points where the arms extend from the turret causes imbalance when a full roll of sheet material is loaded on one spindle and the other spindle has a substantially depleted roll of sheet material thereby urging the turret to rotate under the influence of gravity to position the full roll of sheet material in a dispensing position;

retaining means to secure the roll of sheet material on each spindle; and a limit gate located adjacent said dispensing position to impede rotation of the turret when the limit gate encounters a roll of sheet material that is less than substantially depleted.

2. The apparatus of claim 1, including a first cantilevered spindle extending from a distal portion of a first arm and a second cantilevered spindle extending from a distal portion of a second arm.

3. The apparatus of claim 1, wherein the limit gate is a limit roller.

4. The apparatus of claim 1, wherein the limit gate is a limit pin.

5. The apparatus of claim 1, wherein the limit gate is adjustable.

6. The apparatus of claim 1, wherein the limit gate is affixed to the housing.

7. The apparatus of claim 1, wherein the turret comprises a circular disc.

8. The apparatus of claim 1, wherein the turret comprises struts extending radially outward from and joined at a central point.

9. The apparatus of claim 1, wherein the turret is attached to the housing.

10. The apparatus of claim 1, wherein the housing comprises a front wall, a top wall, and side walls.

11. The apparatus of claim 1, wherein the housing includes a pivoting cover.

12. A gravity-operated apparatus for sequentially dispensing sheet material from rolls of sheet material wound on cores, the apparatus comprising:

a housing having an opening;

a turret rotatable about a central point, said turret being located on a vertical wall of the housing and rotatable in a plane generally parallel to the plane of the vertical wall;

a first arm and a second arm extending perpendicularly from the turret at respective locations radially outward from said central point a sufficient distance to provide clearance for a roll of sheet material;

a cantilevered spindle extending perpendicularly from a distal portion of each arm in the general direction of the central point so that each spindle is positioned generally parallel to the plane of rotation of the turret and is adapted to receive a roll of sheet material wound on a core, each spindle having a length that is greater than the longest distance between the points where the arms extend from the turret, whereby the difference between the length of each spindle and the longest distance between the points where the arms extend from the turret causes imbalance when a full roll of sheet material is loaded on one spindle and the other spindle has a substantially depleted roll of sheet material thereby urging the turret to rotate under the influence of gravity to position the full roll of sheet material in a dispensing position;

retaining means on each spindle to secure the roll of sheet material on each spindle, said retaining means comprising at least one rotatable sleeve on at least one end of a spindle which provides a friction fit with a core of a roll of sheet material wound on a core; and a limit gate located adjacent said dispensing position to impede rotation of the turret when the limit gate encounters a roll of sheet material that is less than substantially depleted.

13. The apparatus of claim 12, wherein the turret comprises a circular disc.

14. The apparatus of claim 12, wherein the turret comprises struts extending radially outward from and joined at said central point.

15. The apparatus of claim 12, wherein the turret is attached to the housing.

16. The apparatus of claim 12, wherein the housing comprises a front wall, a top wall, and side walls.

17. The apparatus of claim 12, wherein the housing includes a pivoting cover.

18. A gravity-operated apparatus for sequentially dispensing tissue from rolls of tissue wound on cores, the apparatus comprising:

a housing having an opening;

a turret comprising struts extending radially outward from and joined at a central point, said turret being located on a vertical wall of the housing and rotatable in a plane generally parallel to the plane of the vertical wall;

a first arm and a second arm extending from the rotatable turret at respective locations radially outward from said central point a sufficient distance to provide clearance for a roll of tissue;

a cantilevered spindle extending perpendicularly from a distal portion of each arm in the general direction of the central point so that each spindle is positioned generally parallel to the plane of rotation of the turret and is adapted to receive a roll of tissue wound on a core, each spindle having a length that is greater than the longest distance between the points where the arms extend from the turret, whereby the difference between the length of each spindle and the longest distance between the points where the arms extend from the turret causes imbalance when a full roll of tissue is loaded on one spindle and the other spindle has a substantially depleted roll of tissue thereby urging the turret to rotate under the influence of gravity to position the full roll of tissue in a dispensing position;

retaining means on each spindle to secure the roll of tissue on the spindle, said retaining means comprising at least one rotatable sleeve on at least one end of a spindle which provides a friction fit with a core of a roll of sheet material wound on a core; and a limit gate affixed to the housing and located adjacent said dispensing position to impede rotation of the turret when the limit gate encounters a roll of tissue that is less than substantially depleted.

19. The apparatus of claim 18, wherein the turret is attached to the housing.

20. The apparatus of claim 18, wherein the housing includes a pivoting cover.

* * * * *